United States Patent [19]

Heller

[11] 3,979,531

[45] Sept. 7, 1976

[54] FLUIDIZED BED TOP SURFACE STABILIZATION MECHANISM

[75] Inventor: Arthur D. Heller, Horseheads, N.Y.

[73] Assignee: Dart Industries Inc., Los Angeles, Calif.

[22] Filed: May 22, 1974

[21] Appl. No.: 472,006

Related U.S. Application Data

[63] Continuation of Ser. No. 272,700, July 17, 1972, abandoned.

[52] U.S. Cl. ..... 427/185; 118/404; 118/DIG. 5; 427/195

[51] Int. Cl.[2] ..... B05D 1/12; B05D 1/24

[58] Field of Search ..... 117/18, 21, DIG. 6; 118/308, 404, 429, DIG. 5; 427/185, 195

[56] References Cited

UNITED STATES PATENTS

| | | | |
|---|---|---|---|
| 2,549,908 | 4/1951 | Johansen | 118/17 |
| 2,719,093 | 9/1955 | Voris | 117/DIG. 6 |
| 2,750,681 | 6/1956 | Berry | 117/DIG. 6 |
| 2,815,550 | 12/1957 | Valyi | 117/DIG. 6 |
| 2,907,299 | 10/1959 | Weiner | 117/DIG. 6 |
| 2,936,733 | 5/1960 | Duggins | 118/429 X |
| 2,938,276 | 5/1960 | Doleman et al. | 117/DIG. 6 |
| 2,981,631 | 4/1961 | Nagel | 117/21 X |
| 2,987,413 | 6/1961 | Dettling et al. | 117/21 |
| 3,233,582 | 2/1966 | Sharetts et al. | 118/DIG. 5 |
| 3,807,355 | 4/1974 | Goldberg | 118/DIG. 5 |

*Primary Examiner*—Michael R. Lusignan
*Assistant Examiner*—Shrive P. Beck
*Attorney, Agent, or Firm*—Paul R. Wylie; Leigh B. Taylor; Kenneth J. Hovet

[57] ABSTRACT

A screen or plate is positioned above and adjacent the normal fluidized pulverulent material top surface level in a typical fluidized bed construction. The screen extends over substantially the entirety of the bed and has enlarged openings therein of a size suitable for the acceptance of the articles that are to be immersed in the pulverulent or powder material. Screen placement within the fluidized bed is also such that upon article immersion into the entrained powder bed, the magnitude of the powder level increase insures that there is at least contact between the screen and bed top surface which will stabilize the bed top surface and preserve the continuity thereof during article immersion and removal. Similarly, an intermittently operable material feeding system is contemplated to assure that a substantially uniform and constant amount of pulverulent material is maintained in the bed during the coating operation.

2 Claims, 7 Drawing Figures

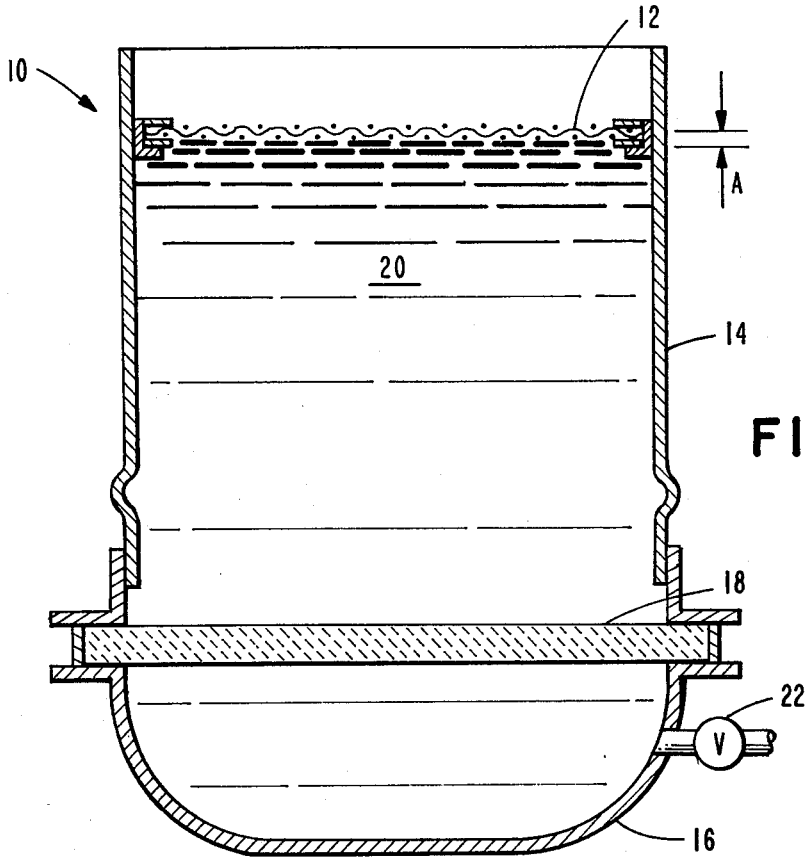
FIG.—1
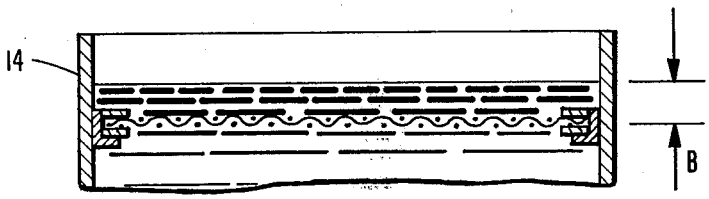
FIG.—2
FIG.—3
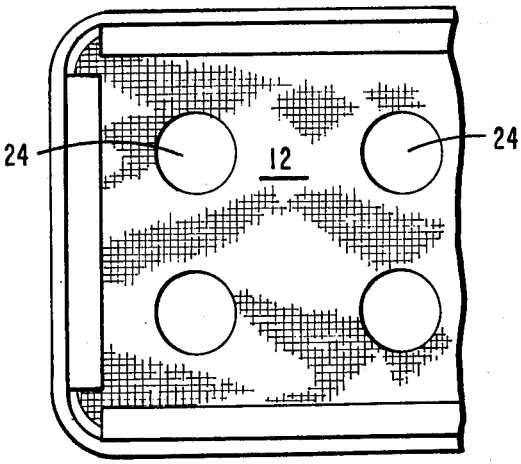
FIG.—4
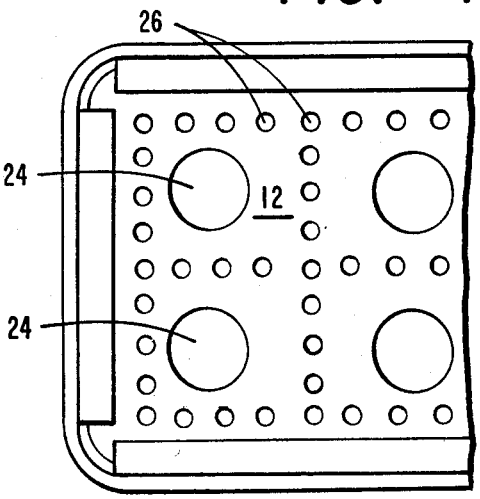

FLUIDIZED BED TOP SURFACE STABILIZATION MECHANISM

This application is a continuation of application, Ser. No. 272,700, filed July 17, 1972, now abandoned.

This invention relates to a fluidized bed coating apparatus and, more particularly, to a device for stabilizing the powder top surface characteristics in such beds during the partial immersion of articles therein.

Fluidized bed constructions and coating processes are, of course, well known. Similarly, the basic structural configuration of such beds is relatively uncomplicated and straight forward. Prior art development has, however, failed to contemplate or appreciate that certain problems are presented when typical bed constructions are employed in the partial coating of articles. Such problems arise when a consistently positioned and uniform coating parting line is necessitated by the type of article and the coating configuration that is to be applied thereto.

In particular, it should be appreciated that, dependent upon the shape of the article to be coated, as well as upon the number of articles which will be immersed into the pulverulent bed material and the article action (i.e., direction, speed and entrained movement) during immersion, the top surface portion of the bed will become distorted. Such distortion will generally take the form of bed unevenness, top surface cratering, or the like, which, of course, will inherently then produce a variance in the coating parting line on the articles.

The importance of a uniform coating parting line may be aesthetic, utilitarian or both and normally will result where only a partial immersion of the article is anticipated. Regardless of the reasons necessitating such parting line uniformity, and especially in circumstances where multiple articles are to be dipped simultaneously and dipping of same is to be on a rapidly repeating basis, commercially available and/or prior art disclosed apparatus will be found to be deficient in the noted respects.

Accordingly, this invention provides for the inclusion of a screen or a similarly configured plate member that is positioned above but proximate the normal fluidized pulverulent material level in the bed. This member must be either self supporting or be adequately supported in a uniform fashion over substantially the entirety of the bed and will also be provided with appropriately positioned openings to accommodate the articles to be coated as they are immersed and withdrawn from the bed.

The proximity of the screen to the powder bed top surface is such that upon article immersion into the powder bed its elevational increase due to powder particle displacement will assure contact between the screen and powder. In fact, the level may be such that the screen becomes entirely immersed. However, in either case the contact with or immersion of the screen has the effect of minimizing surface turbulence and thus maintains a pulverulent material surface uniformity that will generate a coating parting line consistency within suitable tolerances.

In an alternative embodiment, it is also contemplated that the noted screen may be mounted at or on the open top of the fluidization or powder chamber. In this position and upon article immersion as the powder boils over the screen, the chamber side walls will act as weirs and thereby further control the bed level.

Of course, in either of the above embodiments it is imperative that a controlled feeding mechanism replenish the pulverulent material in quantities sufficient to replace those removed as article coating. This will assure the maintenance of a relatively uniform amount of powder or pulverulent material in the bed proper which is critical to the proper functioning of the instant invention.

The principal objective of the invention therefore, is to provide a fluidized bed construction which includes a means to stabilize the top surface area of the pulverulent material in the powder bed and which will thereby reduce turbulence on the bed surface during article immersion therein.

Other advantages and objective of the invention will become more apparent from a further review of the following specification, claims and drawings wherein FIG. 1 is a vertical cross-section of a typical fluidized bed modified to include a screen or similar plate positioned proximate the top surface of the pulverulent material in the powder bed;

FIG. 2 is a partial vertical cross-section of the fluidized bed shown in FIG. 1 and further illustrating how the bed top surface may be elevated above the screen member during immersion of articles into such bed;

FIG. 3 is a partial top view of the fluidized bed shown in FIGS. 1 and 2 illustrating the enlarged openings which are provided in the screen or plate so that the articles to be coated may be immersed into the powder bed;

FIG. 4 is a partial top view of another embodiment of the stabilization plate member forming a part of this invention;

Figure 5:
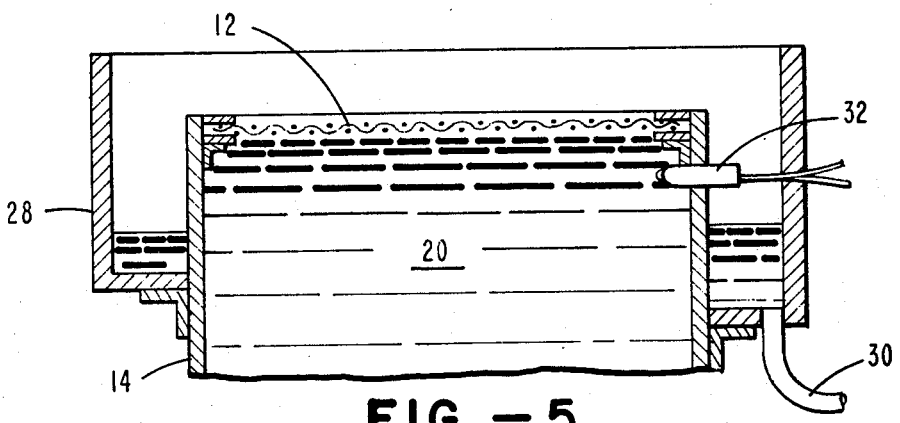
FIG. 5 is a partial vertical cross-section showing a fluidized bed similar to that of FIG. 1 but also illustrating another embodiment of the invention wherein the stabilization screen is placed adjacent the top extremity of the fluid bed and the side walls thereof serve as weirs for the rising powder material immersion of articles.

As has been indicated above, in most instances the typical fluidized bed coating operation does not necessitate the accurate control of powder level within the bed. Further, in dipping operations in which only partial article immersion is anticipated, turbulent surface conditions may be created that will not restabilize prior to subsequent article immersion. Thus, where there is some criticality with respect to the coating parting line on the article bed top surface stabilization and control also becomes imperative.

Referring now to FIG. 1, in particular, it can be seen that among other things the present invention contemplates the inclusion in a typical fluidized bed construction 10 of a screen 12 or some similarly perforated plate member suitably supported around the bed sidewalls 14 in a position proximate to the top surface of the fluidized pulverulent material 20 of the powder chamber. As is indicated by the dimension A the screen is elevated above the fluidized powder top surface by some small amount A. The dimensional extent of A may, of course, vary depending upon the size shape and number of articles that are to be dipped simultaneously since in all instances it is imperative that upon article immersion the powder level must be elevated by the amount A which will at least assure contact with the screen 12. In fact, in some instances, it may be desirable to have the bed level due to immersion of articles therein increase substantially more than amount A so as to totally immerse the screen as is shown in FIG. 2. There it can be seen that the powder bed level is above the screen by some amount B which amount will be subject to experimental determination based upon the conditions of article immersion.

As has been indicated, the overall bed construction is typical of those found in fluidized coating processes and includes the bed 10 which is formed by the flanged plenum chamber 16, impervious side walls 14, and the typical lower gas pervious distribution or diffuser plate 18 that establishes and separates the noted plenum chamber 16 from the upper open-topped fluidization or powder chamber. The heat fusable pulverulent coating material 20 is, of course, retained above the distribution plate 18 and upon the introduction of some suitable fluidizing gas through conduit and valve 22, the pulverulent material 20 is fluidized due to the passage of the fluidizing medium through the porous distribution plate 18.

FIG. 3 and 4 are illustrative of the type of plate that may be employed in carrying the invention to fruition. For example, a typical screening type of material as is shown in FIG. 3 and having a mesh size of between 1/32 and ¾ inch may be employed so long as it is suitably and uniformly supported in a generally horizontal position above the normal powder level. However, as is apparent from the FIG. 4 disclosure, other materials of construction such as radiator metal or some other perforated plate material, may serve equally well. Regardless of the material selected for usage, it is, of course, necessary to provide enlarged openings 24 therein through which the articles to be coated may be accommodated.

Thus, the articles being treated by the fluidized process incorporating the substance of this invention will be transported to a position above the bed 10 and thereafter lowered through the openings 24 into the powder proper. Such immersion will result in the displacement of pulverate material 20 so that the bed top surface level rises to a position at least in contact with the screen 12 and preferably to a position so that that screen is almost wholly immersed in the powder bed. This screen immersion will result in the stabilization of the bed top surface and the minimizing of the turbulence along that surface due to article immersion. Similarly, as the articles are withdrawn the bed surface will likewise remain stabilized and, therefore, will be in a general condition suitable for the immediate acceptance of additional articles for coating.

Referring again to FIG. 4 note that the enlarged openings 24 are surrounded by a predetermined pattern of smaller openings 26 through which the pulverulent material may exude to a position above that plate or screen 12. The placement pattern and number of such perforations will, of course, depend upon the articles being coated as well as the bed size and other features which are also fully determinable through minor experimentation.

In each of the FIGS. 1 through 4 it will be apparent that the screen or plate members 12 have been positioned in the fluidized powder chamber a position substantially below the open top thereof. Thus, any increase in the top surface level of the pulverate material 20 will be retained within the powder chamber. The disclosure as evidenced in FIG. 5 through 7 however, offer an alternative to that as is above described but do however, include the retention of screen 12. In this alternative embodiment the fluidization chamber substantially remains the same and includes similar impervious side wall members 14. The screen 12, however, is now positioned immediately adjacent the to opening of the noted chamber and in effect acts as a cover-like element for that chamber. Now, as articles are immersed through the openings 24 into the powder material, the top surface level of that bed will, of course, again rise but in this case it will tend to overflow the side walls 14 which act as weirs. Thus, a further leveling effect and maximum retention of material in the bed will be controlled through the overflow of weir type action.

In addition, this particular fluid bed incorporates an overflow container 28 which is affixed to the sidewalls 14 of the fluid bed and which is further adapted to gravitationally discharge any pulverulent material which overflows the sidewalls 14 through a suitable conduit means 30. The basic operation of this alternative embodiment therefore is substantially similar to that as is hereinabove described but includes the noted additional control feature of the weir-like overflow mechanism.

Figure 6:
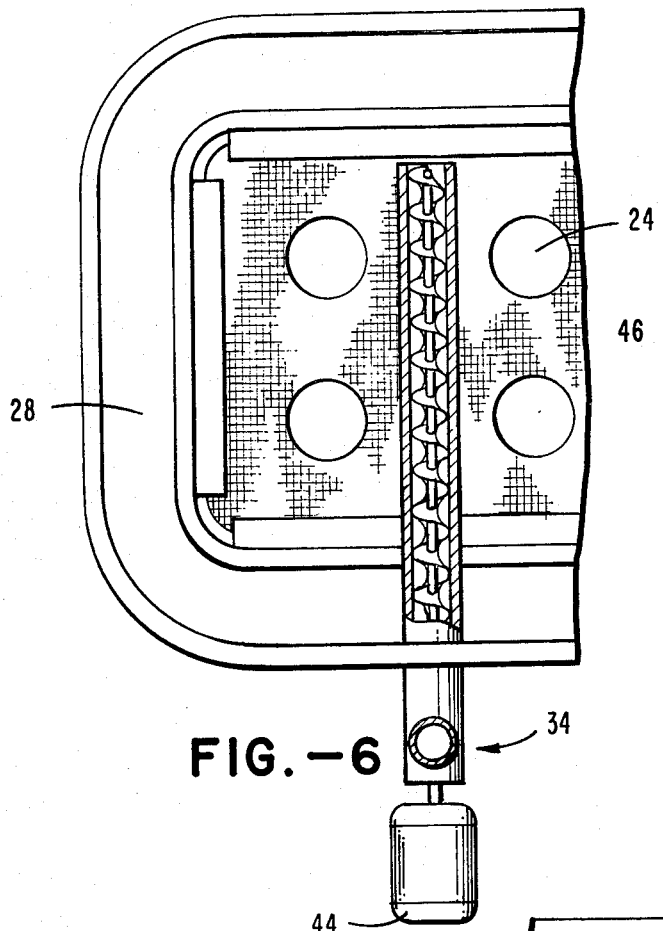
FIG. 6 is partial top view of FIG. 5 and also illustrates a typical feeding mechanism which functions to replenish pulverulent material to the bed during the coating process.
Figure 7:
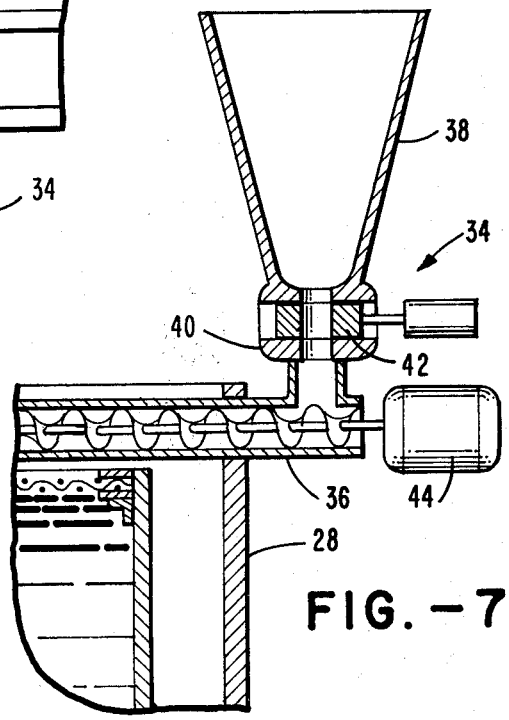
FIG. 7 is a partial vertical cross-section further illustrating the showing of FIG. 6 wherein the powder feeding mechanism shown there is more fully illustrated.

FIG. 5 also illustrates a photo-electric means 32 which in turn is interconnected with the feeding means 34 shown in both FIGS. 6 and 7. This photo-electric control 32 is, of course, designed to maintain a constant bed level in the powder chamber. Maintenance of such a constant level is, of course, also a requirement if a constant parting line level on the coated article is to be maintained. However, it should be appreciated that even with the maintenance of such constant level, the addition of the screen 12 is significant to achieving the parting line quality and consistency that is necessary.

With continued reference to FIGS. 6 and 7 also note the inclusion of an intermittently operable feeding mechanism positioned above the fluidizing chamber and extending into such chamber. This feeding mechanism 34 includes an auger screw type device which is fed from a storage container 38 through a suitable valving mechanism 40 and 42 into the mentioned device. The auger as can be seen is powered by any suitable driving means, for example, motor 44 which may be either continuously operable or intermittently activated responsive to signals received from the photoelectric mechanism 32. It should be noted at this point that some other mechanical or fluid sensing device may be employed to sense the bed level if such is desired and, in fact, this may be omitted and a timing circuit may be used to cycle the valve 40 in a repetitive sequence response to other machine operations. In the event that the auger is continuously driven the signals from photo-electric means 32 may be transmitted to a solenoid 45 or some other similar operating mechanism which will activate the gate 42 in valve 40. The cycling of this gate, of course, will allow the deposit of fixed quantities of pulverulent material into the auger mechanism 36 and which subsequently will deliver that material to the bed top surface.

Although this feeder is disclosed in conjunction with the embodiment illustrating the overflow container, it should be apparent that it is equally adapted where such overflow device is not incorporated into the fluidized bed arrangement. Likewise, it should be apparent that the auger feed mechanism 36 may be extended across the entirety of the bed surface, such as is shown in phantom in FIGS. 6 and 7 and that such may include a plurality of spaced openings 46 along the bottom extent thereof through which the pulverulent material may be deposited evenly across the bed surface. This, of course, will result in a more even distribution and a more instantaneous bed level control. The necessity of such, however, will be dependent upon the cyclic operation of the machine and especially the frequency thereof.

From the foregoing it should be apparent that the instant invention provides for a distinctly improved coating apparatus which is suitable for the processing of articles where it is important that a uniform and consistent parting line of the coating be maintained. Obviously, many modifications and variations of the present invention are possible in light of the above teachings.

I claim:

1. In a method of coating an article by means of a fluidized bed coating technique wherein a fluidization chamber is utilized having impervious side walls, a gas pervious distributor plate adapted to support a bed of pulverulent coating materials, an open top, and having means for passing fluidizing gases upwardly through said gas distributor plate to fluidize said pulverulent materials, the improvement comprising:

a. providing a generally horizontally disposed means of a generally perforate configuration and including at least one enlarged opening therein of sufficient size to accommodate the passage of an article therethrough for total or partial immersion in said fluidized bed, b. positioning said horizontally disposed means and controlling the pulverulent coating materials and the fluidizing gases in a manner such that said horizontally disposed means will engage only the upper most surface of the fluidized pulverulent coating materials, said horizontally disposed means and said pulverulent coating materials being below the top of the impervious side walls of said fluidization chamber, c. emersing an article in said fluidized bed by inserting it through said enlarged opening for a time sufficient to coat said article and then withdrawing it from said opening.

2. The method according to claim 1 wherein said horizontally disposed means is a screen having perforations of approximately between about 1/32 and ¾ inch in size.

* * * * *